US007001532B2

(12) United States Patent
Ishibashi et al.

(10) Patent No.: US 7,001,532 B2
(45) Date of Patent: Feb. 21, 2006

(54) ELECTRO-RHEOLOGICAL COMPOSITION

(75) Inventors: Akira Ishibashi, Toyama (JP); Takeshi Fukuda, Kurobe (JP); Ryoichi Hanaoka, 2-11-1, Moriyama, Kanazawa-shi, Ishikawa-ken (JP); Shinzo Takata, Ishikawa-ken (JP)

(73) Assignees: Kinsei Matec Co. Ltd., Osaka (JP); Ryoichi Hanaoka, Ishikawa-ken (JP)

( * ) Notice: Subject to any disclaimer, the term of this patent is extended or adjusted under 35 U.S.C. 154(b) by 201 days.

(21) Appl. No.: 10/299,898

(22) Filed: Nov. 20, 2002

(65) Prior Publication Data

US 2003/0098439 A1 May 29, 2003

(30) Foreign Application Priority Data

Nov. 29, 2001 (JP) ..... 2001-364553
Mar. 22, 2002 (JP) ..... 2002- 081911

(51) Int. Cl.
*C10M 171/00* (2006.01)
*C10M 169/04* (2006.01)

(52) U.S. Cl. ..... 252/71; 252/73; 252/518.1

(58) Field of Classification Search ..... 252/73, 252/74, 572, 500, 518.1, 71
See application file for complete search history.

(56) References Cited

U.S. PATENT DOCUMENTS 5,106,521 A 4/1992 Kurachi et al.
5,326,633 A 7/1994 Clough et al.
5,412,006 A 5/1995 Fisher et al.
5,705,088 A * 1/1998 Sasaki et al. ..... 252/73

FOREIGN PATENT DOCUMENTS

CA 2104405 2/1994
EP 0 319 201 A2 6/1989
EP 0 563 653 A1 10/1993

(Continued)

OTHER PUBLICATIONS

Mori et al.; "Development of Electro-Rheological (ER) Fluid"; CMC, pp. 277-279, (1999).

(Continued)

*Primary Examiner*—Mark Kopec
(74) *Attorney, Agent, or Firm*—Finnegan, Henderson, Farabow, Garrett & Dunner, L.L.P.

(57) ABSTRACT

In an electro-rheological composition comprising an electrical insulating medium and solid particles dispersed therein, insulating solid particles possessed of morphological anisotropy are used as the solid particles. In a preferred embodiment, the insulating solid particles mentioned above are plate-like insulating solid particles, preferably plate-like insulating solid particles having a diameter (particle diameter) not less than 1 μm, more preferably plate-like aluminum oxide particles having a diameter not less than 1 μm. In another preferred embodiment, the insulating solid particles which have undergone a surface treatment with organic molecules or a semiconducting inorganic material, particularly the insulating solid particles having a metal oxide such as tin oxide and titanium oxide adhered to the surfaces thereof are used as the particles. Still another preferred embodiment is the ER composition of which electrical insulating medium is gelled.

17 Claims, 4 Drawing Sheets

FOREIGN PATENT DOCUMENTS

| | | | |
|---|---|---|---|
| EP | 0 583 763 | A2 | 2/1994 |
| EP | 0 589 637 | | 3/1994 |
| EP | 0 625 566 | A1 | 11/1994 |
| JP | 5-17791 | | 1/1993 |
| JP | 6-192672 | | 7/1994 |
| JP | 07157784 | | 6/1995 |
| JP | 7-258412 | | 10/1995 |
| JP | 2001 10 26793 | | 1/2001 |
| RU | XP-002233331 | | 10/1991 |

OTHER PUBLICATIONS

XP-002233330—*Journal Of Intelligent Material Systems and Structures* "The Effect of Particle Shape On Water-free Mica ER Fluids", vol. 11, No. 1, p 4, dated Jan. 2000, Technomic Publishing USA, (Authors: Duan Xiaodong, Luo Weili, H. Chen, He Yuanjin).

* cited by examiner

ELECTRO-RHEOLOGICAL COMPOSITION

BACKGROUND OF THE INVENTION

1. Field of the Invention

This invention relates to compositions which exhibit the electro-rheological (ER) effect. More particularly, this invention relates to electro-rheological (ER) compositions, also sometimes termed electro-viscous (EV) compositions, which contain no water, can be operated stably even in an increased temperature, and can be used for power transmission devices and damping equipment such as, for example, printers, valves, clutches, dampers, shock absorbers, vibrators, engine mounts, and actuators.

2. Description of the Prior Art

The ER effect is such a phenomenon that when dielectric substances are dispersed in an electrical insulating medium, the viscosity thereof increases remarkably under the influence of an electric field applied thereto due to the orientation of these substances. As the electrical insulating medium, silicone oil, fluorinated silicone oil (JP-6-192672,A, for example), transformer oil and the like are used. On the other hand, as the dielectric substance, silica, barium titanate, ion-exchange resins, argillaceous minerals (JP-7-258412, A), starch, metal, etc. are used.

Further, it is known in the art that when the dielectric substance contains a small amount of water, the ER effect will be improved remarkably (Development of Electro-rheological (ER) Fluid, CMC, 1999).

When the dielectric substance contains water, however, the usable temperature range is restricted to the range in which water can maintain its liquid state and the performance of the ER fluid is extremely deteriorated in a lower temperature range and a higher temperature range. Further, the addition of water will enhance the electrical conductivity of the whole of the system and permits the passage of an electric current, which poses such a drawback that a power supply to be needed becomes large. Moreover, the system generates heat by the electric current and the heat generation is runaway. As a result, the deterioration of its performance is promoted.

For the purpose of eliminating such drawbacks, JP-5-17791,A proposes to use solid particles comprising conductor or semiconductor oxide particles each containing an electrical insulating oxide layer formed on the surface thereof. When the system to be used contains as the dielectric substance such conductor or semiconductor oxide particles covered with an inorganic oxide layer, the usable temperature range becomes widened. However, it poses the problem of not being suitable for long-term use because fine particles generated by the mutual collision of particles and wear thereof while in use are dispersed in the whole system and, as a result, the insulating ability of the whole system will be decreased to such a degree that the stability is deteriorated.

SUMMARY OF THE INVENTION

An object of the present invention, therefore, is to provide ER compositions which are usable in a wide temperature range, exhibit excellent ER effect without adding water thereto, have sufficient heat resistance, and can be used stably for a long period of time.

A further object of the present invention is to provide the compositions which exhibit high ER effect with controlled electrical conductivity by the suitable treatment of the surfaces of solid particles to be dispersed in an electrical insulating medium.

To accomplish the objects described above, the present invention provides an ER composition comprising an electrical insulating medium and solid particles dispersed therein, characterized in that the solid particles mentioned above are insulating solid particles possessed of morphological anisotropy.

In a preferred embodiment, the insulating solid particles possessed of morphological anisotropy mentioned above are plate-like insulating solid particles, preferably plate-like insulating solid particles having a diameter (particle diameter) not less than 1 $\mu$m, more preferably plate-like aluminum oxide particles having a diameter (particle diameter) not less than 1 $\mu$m.

In a more concrete preferred embodiment, the plate-like solid particles mentioned above are aluminum oxide, boehmite, or $\alpha$-alumina, particularly the plate-like aluminum oxide having an aspect ratio not less than 5, preferably plate-like aluminum oxide produced by hydrothermal synthesis.

In another preferred embodiment, as the insulating solid particles of plate-like aluminum oxide etc. mentioned above, those which have undergone a surface treatment with organic molecules or semiconducting inorganic materials, particularly the insulating solid particles having a metal oxide such as tin oxide and titanium oxide adhered to the surfaces thereof are used.

In still another preferred embodiment, the composition is an ER composition of which electrical insulating medium is gelled.

In accordance with another aspect of the present invention, there is provided an ER composition defined by its physical properties, i.e. the particle dispersion type ER composition which exhibits an electric current not more than 1 $\mu A/cm^2$, preferably not more than 0.5 $\mu A/cm^2$, under the application of an electric field of 2 kV/mm and the change in viscosity (or shear stress) at the same voltage of not less than 10 times the viscosity under no application of the electric field.

In accordance with the present invention, since the insulating solid particles possessed of morphological anisotropy such as the plate-like solid particles, especially of plate-like aluminum oxide are used as the solid particles in the ER fluid comprising an electrical insulating medium and solid particles dispersed therein, there is provided the ER composition which is usable in a wide temperature range, exhibits excellent ER effect without adding water thereto, possesses sufficient heat resistance, and can be used stably for a long period of time. By adhering a semiconducting inorganic material such as a metal oxide to the surfaces of the insulating solid particles, it is possible to obtain the ER composition which exhibits high ER effect with controlled electrical conductivity. By subjecting the insulating solid particles to a surface treatment with organic molecules, it is possible to keep a good dispersion state of the resultant composition. Further, by gelling the electrical insulating medium, it is possible to lower the electrical conductivity of the composition remarkably.

BRIEF DESCRIPTION OF THE DRAWINGS

Other objects, features, and advantages of the invention will become apparent from the following description taken together with the drawings, in which.

DETAILED DESCRIPTION OF THE INVENTION

The ER effect appears when the particles dispersed in a liquid is dielectrically polarized by a high electric field and mutually arranged in a row to form a bridge. This bridge may connect electrodes and the power required for destroying the bridge is observed as elastic breaking strength. Therefore, this means the addition of an elastic ingredient equivalent to the initial elasticity of a Bingham fluid to the simple viscosity, which is observed as the increase of the degree of viscosity.

The usual ER fluid is formulated as a composition comprising fine spherical solid ingredients dispersed in insulating oil, as disclosed in JP-11-349978,A and JP-2001-26793, A. They focus on the dielectric characteristics of a solid particle of which form is spherical.

On the contrary, the present inventors have found that the insulating solid particles possessed of morphological anisotropy and dispersed in an electrical insulating medium exhibit the ER effect and that the ER effect is high in proportion as their anisotropy is large.

Specifically, in accordance with the findings of the present inventors, the ER composition containing insulating solid particles dispersed in an electrical insulating medium becomes the ER composition which exhibits low current density upon the application of an electric field owing to the insulating properties of the dispersed insulating solid particles of morphological anisotropy and is usable in a wide temperature range. Particularly, when the plate-like solid particles of morphological anisotropy, such as plate-like aluminum oxide particles, are dispersed in the medium, the resultant ER composition exhibits excellent ER effect owing to the large anisotropy of the particles.

The insulating solid particle possessed of morphological anisotropy can be classified into a fiber-like particle, a needle-like particle, and a plate-like particle as follows. As the respective typical examples, the following may be cited.

Fiber-like: fiber-like solid particles obtained by grinding glass fibers, vinylon fibers, alumina fibers, etc.

Needle-like: potassium titanate, slag fibers, wollastonite, sonolite, phosphate fibers, gypsum fibers, dawsonite, asbestos, needle-like magnesium hydroxide, etc.

Plate-like: talc, mica, sericite, glass flakes, plate-like calcium carbonate, hydrotalcite, plate-like aluminum hydroxide, plate-like aluminum oxide, etc.

The effects of the use of the insulating solid particles of morphological anisotropy as insulating solid particles to be dispersed in an electrical insulating medium will be described below by taking the case of aluminum oxide as an example.

Figure 1:
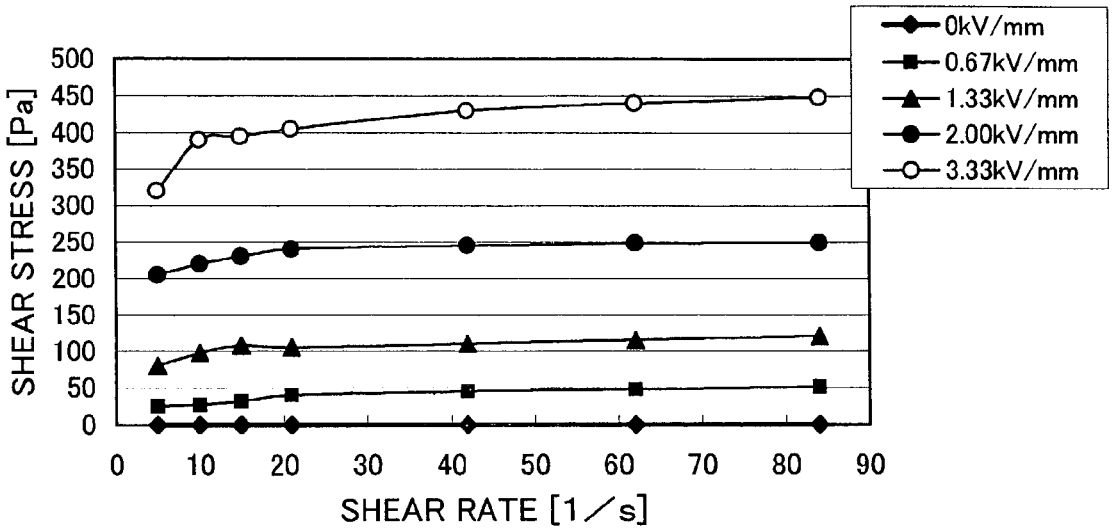
FIG. 1 is a graph showing the change of shear stress with the shear rate measured under the application of various electric fields to the ER composition prepared in Example 1 to be described hereinafter.

Usual alumina is a spherical fine particle. The ER effect by the spherical alumina particles is reported in "Yasuo Mori: The Society of Powder Technology, Japan, Autumn Research Presentation Meeting, Summary, p. 277, (1993) Tokyo." The spherical alumina does not exhibit so high ER effect. On the other hand, the plate-like alumina (for example, SERATH YFA10030 manufactured by YKK Corporation) exhibits high ER effect, as shown in FIG. 1 to be described hereinafter. A person skilled in the art can understand such effect by morphological anisotropy from the relation of the dipole moment caused by polarization to the orientation of particles.

That is to say, when spherical dielectric materials are placed in a strong electric field, the electric charge induced by polarization is oriented in the direction parallel to the line of electric force according to the line of electric force. Since the spherical particle is symmetrical in all the directions, it can rotate freely even in an electric field. On the other hand, in the case of an odd-shaped particle or plate-like particle, it can take lower potential when so oriented that its longer side become parallel with the line of electric force. Accordingly, the plate-like particle will be arranged in parallel with the line of electric force. This holds good for the case of other morphologically anisotropic particles.

Further, the plate-like particle has a tip of an acute angle as compared with the spherical particle and thus the degree of concentration of the line of electric force in the plate-like particle compares favorably with that in the spherical particle. Therefore, the polarization in a tip thereof becomes larger and the effect of attracting particles each other by polarization becomes large.

It is known in the art that a suspension containing the plate-like particles dispersed therein has a card house structure (or edge to face structure) therein (see "Ceramics Dictionary" compiled and edited by Pottery Industry Association, Maruzen Co., Ltd., p. 70). When the flow starts; the card house structure will be broken, the particles orient in parallel with the direction of a streamline, and the viscosity of the liquid decreases. Such change is the characteristics of the molphologically anisotropic particles such as plate-like particles. When a voltage is applied perpendicularly to the flow direction, the plate-like particles oriented in parallel with the electric field have larger projected areas in the flow direction (the direction perpendicular to the electric field). Accordingly, the projected areas are large by the part of an aspect ratio as compared with the case where they are arranged in parallel with the flow direction and the particles function as resistance to the flowing medium.

The aspect ratio used herein is defined as the value obtained by dividing an average particle diameter of the molphologically anisotropic particles by an average thickness thereof. The average thickness of particles and the average particle diameter are obtained by selecting arbitrarily ten particles from a group of particles by the observation through a scanning electron microscope and measuring the thickness, long diameter, and short diameter thereof. The average thickness of particles is defined as the arithmetic average of ten thicknesses and the average particle diameter is defined as the arithmetic average of ten values of (long diameter+short diameter)/2.

The Bingham characteristics of the ER fluid are explained by the bridge structure formed between electrodes and its breakage. In the case of plate-like particles, the viscosity of the fluid increases simply when they orient perpendicularly to the direction of flow by the influence of electric field. This is because the linear velocity of the flowing liquid is so distributed that the velocity is slow at a tube wall portion and is high in the center portion and the plate-like particles oriented perpendicularly by the electric field act as baffles against the distribution. Such function is the characteristics peculiar to the molphologically anisotropic particles such as plate-like particles and the spherical particles are possessed of no such function.

The aspect ratio exerts significant influence on the ER effect of such plate-like particles. The plate-like particles having an aspect ratio smaller than 5 exhibit unsuitably lower ER effect. The ER effect appears if the aspect ratio is not less than 5 and increases in proportion as the aspect ratio becomes large. However, if the aspect ratio is unduly large so as to exceed 80, the excess will entail such a disadvantage that the initial degree of viscosity of the fluid in the state under no application of voltage tends to become excessive so as to be unsuitable for use.

Further, the size of the plate-like particle is also a factor of significant influence. If sedimentation is taken into consideration, the smaller particles are advantageous. However, the plate-like particles having a diameter (particle diameter) less than 1 $\mu$m exhibit lower ER effect. The ER effect increases in proportion as the average particle diameter becomes large. Practically, in consideration of the sedimentation rate etc., a suitable range is 1 $\mu$m or more and 20 $\mu$m or less. From the balance of the sedimentation rate and the ER effect, the most preferred range is 5 $\mu$m or more and 12 $\mu$m or less.

As the insulating solid particles to be used in the present invention, aluminum oxide is preferred. The "aluminum oxide" as used in this specification also includes aluminum oxide hydrates (or aluminum hydroxide) expressed as $Al_2O_3.nH_2O$. Although the value, n, in aluminum oxide ($Al_2O_3.nH_2O$) may be larger than 1, in this case it is not clear whether the water is water of crystallization or adsorbed water and dehydration takes place easily at a low temperature. Therefore, it is not preferred to use the aluminum oxide having a large "n" because water enters in the system and its temperature stability is impaired.

On the other hand, the water contained in boehmite (n=1) is water of crystallization. The temperature for separation of crystallization water is 560° C. Since this temperature is fully higher than the limit temperature for use of the usual electrical insulating medium such as silicone oil, the separation of crystallization water will not occur while in service. Moreover, the contribution of water to the ER effect is heretofore considered to be effected by the oozing out of water. If this is taken into consideration, the water fixed to the particle as crystallization water will not exert any influence on the ER effect. Therefore, even if boehmite contains water, the ER effect by water does not appear. Accordingly, there is no change of ER effect with temperature. In order to acquire the stable ER effect, boehmite of n=1 or $\alpha$-alumina of n=0 should be used.

Plate-like particles of $\alpha$-alumina or boehmite can be prepared by the hydrothermal synthesis (the method of subjecting the aluminum hydroxide or hydrated alumina having a particle size previously adjusted to the submicron order to the hydrothermal treatment in water or in an aqueous alkaline solution at a high temperature and high pressure, for example, about 350° C. or more and about 200 atmospheric pressure or less for $\alpha$-alumina and about 150° C. or more and about 100 atmospheric pressure or less for boehmite), as disclosed in JP-5-17132,A and JP-5-279019, A, the teachings of which are incorporated here by reference. The particles prepared according to the method disclosed in these patent publications have the fine hexagonal plate-like shapes and their aspect ratios can be adjusted arbitrarily.

When a suspension passes the portion of which flow channel cross-sectional area changes rapidly, such as an orifice, or flows like the strong shearing flow, suspended particles are mutually rubbed to give fine worn particles. However, since aluminum oxide has high hardness and withstands wear, the liquid scarcely suffer deterioration of characteristics by the worn particles which was a problem until now. Furthermore, since aluminum oxide is an insulating material, the liquid does not suffer the decrease of the insulating ability of the electrical insulating medium by the worn particles, which has become a problem when the conductive substances such as semiconductor particles are used. Moreover, since aluminum oxide is an electrical insulating material, even if it is suspended in the liquid in a large amount, the liquid exhibits low electrical conductivity and takes an advantage that the flowing electric current is low when used as the ER fluid.

A method of promoting polarization by forming a thin film of a semiconducting inorganic substance in the surface is disclosed in JP-2001-26793,A, the teachings of which is incorporated here by reference. By forming such an electrically conductive thin film, the Maxwell stress functions in the joining point of particles, as disclosed in "Hanaoka, Takada, Murakumo, Sakurai, and Anzai: Paper Journal A, The Institute of Electrical Engineers of Japan, Vol. 121, p. 136 (2001)" and the ER effect can be heightened. In the insulating morphologically anisotropic particles such as plate-like particles, too, it is effective to treat the particle surfaces with a semiconducting inorganic substance in the similar manner.

For instance, since aluminum oxide does not exhibit electric conductivity, the electrical conductivity of the ER composition having these particles dispersed therein is extremely low. The electrical conductivity thereof can be controlled by adhering a semiconducting metal oxide to the surfaces of the particles. As the semiconducting metal oxide to be adhered to the particles, transition metal oxides possessed of semiconducting properties may be used preferably, and particularly tin oxide and titanium oxide are effective. As to the amount of adhesion of the metal oxide to the surfaces of the above-mentioned insulating solid particles, it is preferred to be not less than 0.01% and not more than 10%, based the weight of insulating solid particles.

Plate-like aluminum oxide having no tin oxide adhered thereto passed a low electric current, and even if 30% of the plate-like aluminum oxide was dispersed in insulating oil, an electric current of only 0.25 $\mu A/cm^2$ or less passed upon the application of an electric field of 2 kV/mm, but the ER effect exhibited the shear stress of 270 Pa at a shear rate of 50 $s^{-1}$.

On the other hand, when plate-like aluminum oxide having tin oxide adhered thereto in an amount of 1% to 10% of the weight thereof was used, even if 30% of the plate-like aluminum oxide was dispersed in insulating oil, an electric current of only 1 $\mu A/cm^2$ or less passed upon the application of an electric field of 2 kV/mm, but the ER effect exhibited the shear stress of 350 Pa at the shear rate of 50 $s^{-1}$.

Further, by adhering a metal oxide to the surfaces of insulating solid particles, it is possible to obtain the composition capable of exhibiting high ER effect while controlling the electrical conductivity. Since the base material possesses insulating properties, it is possible to control the electrical conductivity from a small value. Accordingly, when the ER composition is prepared by dispersing the insulating solid particles having the metal oxide adhered to the surfaces thereof in the insulating medium, it is possible to select the current density and the ER effect of the optimal conditions.

Furthermore, a driving current is a significant factor in use in the application to an object with a large surface area like a damping panel. If the driving current is high, power supply equipment will be inevitably enlarged. Particularly when the ER effect is employed, it needs a high voltage. Accordingly, the required outputs of equipment differ greatly even if the difference between driving currents is small. Therefore, it is important that the driving current should be as low as possible.

When the dispersed particles themselves possess electrical conductivity, as in the case that a transition metal oxide powder or a water-containing resin powder is dispersed in insulating oil, it will be difficult to keep the driving current so as to not exceed 10 $\mu A/cm^2$ in order to acquire sufficient ER effect. Further, even when a metal oxide is adhered onto a spherical particle, it is necessary to heighten the current density similarly in order to acquire sufficient ER effect. On the contrary, when the shape of the insulating solid particle to be dispersed is anisotropy, since the ER effect resorting to an electric current is also obtained in addition to the ER effect owing to the shape, there is obtained an advantage that the electric current required for acquiring the same ER effect is lowered.

When insulating oil, transformer oil, silicone oil, etc. are used a medium of the ER fluid, the plate-like alumina particle has a surface of high polarity as compared with such oil and, thus, it will be difficult to disperse the particles in the medium mentioned above. Particularly when the particle diameter is small, the particles are liable to form an aggregate, without being dispersed in the medium. In such a case, it is possible to subject the plate-like particles to a surface treatment so as to be easily dispersed in the medium. Various coupling agents may be effectively used in the surface treatment. As the coupling agents, a silane-based, titanate-based, and aluminate-based coupling agents may be used.

Any of the electrical insulating liquids may be used as the medium. Particularly, silicone oil and fluorinated silicone oil are preferred in view of their excellent electrical insulating properties and heat resistance. The oil having a suitable degree of viscosity can be selected according to the usage to be adopted.

The content of the insulating solid particles in the electrical insulating medium is preferred to be in range of not less than 10% by weight and not more than 50% by weight, more preferably not less than 25% by weight and not more than 35% by weight. If the content of the insulating solid particles is less than 10% by weight, the fluid will be at a disadvantage in exhibiting insufficient ER effect. Conversely, if the content exceeds 50% by weight, the excess will entail such a disadvantage that the initial degree of viscosity of the fluid in the state under no application of voltage tends to become excessive so as to be unsuitable for use.

Meanwhile, the insulating solid particles dispersed in the electrical insulating medium will sediment gradually when the composition is left at rest. Since the density of the insulating solid particle is different from that of the medium, it is impossible to completely suppress sedimentation of the insulating solid particles dispersed in the medium of a liquid state. As a method of suppressing this sedimentation, gelation of the medium may be adopted. Gelation may be effected by two methods; a method of cross-linking silicone oil itself and a method of adding a cross-linking agent to the medium and causing reaction of the cross-linking agent.

The gelation of silicone oil itself can be performed by adding a suitable peroxide to dialkyl silicone oil containing insulating solid particles, for example, and heating the mixture. As peroxides, benzoyl peroxide (BPO), bis-2,4-dichlorobenzoyl peroxide (DCBP), dicumyl peroxide (DCP), t-butyl peroxide benzoate (TBP), di-t-butyl peroxide (DTBP), 2,5-dimethyl-2,5-di-(t-dibutylperoxy)hexane (DBPMH), etc. may be used. The reaction rate can be increased by using an accelerator such as cobalt naphthenate as a catalyst.

Alternatively, the gelation can be performed by adding an alkylorthosilicate as a cross-linking agent and an organic acid salt of metal such as, for example, dibutyltin dilaurate, tin octenate, and lead octenate as a catalyst to dialkyl silicone oil containing insulating solid particles and left reacting to cause gelation.

In another method of adding a cross-linking agent to the medium, poly(alkyl vinyl siloxane) is added to dialkyl silicone oil containing insulating solid particles and fully dissolved therein, thereafter a peroxide is added thereto, and the mixture is heated.

Further, it is also possible to add a siloxane compound having a double bond such as, for example, crude rubber of methyl vinyl siloxane to dialkyl silicone oil containing insulating solid particles, then add an alkyl hydrogen polysiloxane thereto, and subjecting them to cross-linking reaction in the presence of chloroplatinic acid or its derivative as a catalyst to cause gelation.

In the gelled ER composition prepared, sedimentation of insulating solid particles is not observed even if it is left to stand for a long period of time. Moreover, since the electric current caused by the flow of liquid between electrodes is suppressed by gelation, the current density becomes lower to a level of 0.01 $\mu A/cm^2$ or less.

Now, the present invention will be described specifically below by reference to working examples. Wherever the term "parts" is used hereinbelow, it shall refer to "parts by weight" unless otherwise specified.

EXAMPLE 1

Plate-like alumina particles having an average particle diameter of 10 $\mu m$ and an aspect ratio of 30 (SERATH YFA10030 manufactured by YKK Corporation) were dispersed in fluorinated silicone oil of a modification degree of 40% (the degree of viscosity: 100 centistokes) in a ratio of 30 wt. %. The resultant suspension was placed in a double wall cylindrical viscometer to measure the ER effect by using the inside cylindrical wall as a positive electrode and the outside cylindrical wall as a negative electrode. FIG. 1 shows the change of shear stress with the shear rate measured under the application of various electric fields.

Figure 6:
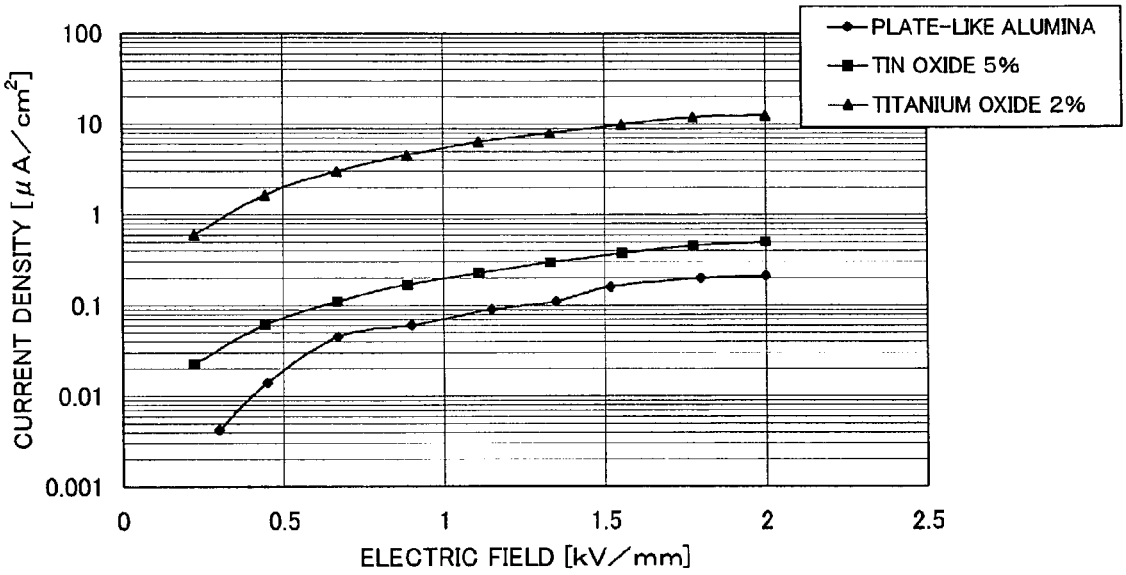
FIG. 6 is a graph showing the change in the current density measured under the application of various electric fields to each of the ER compositions prepared in Example 1, 3 and 5.

As shown in FIG. 1, the suspension exhibited the small shear stress under the application of no voltage (0 kV/mm), but exhibited the shear stress exceeding 200 Pa under the application of the electric field of 2.00 kV/mm. The electric current at that time was 0.21 $\mu A/cm^2$, as shown in FIG. 6.

EXAMPLE 2

Plate-like alumina particles having an average particle diameter of 5 $\mu m$ and an aspect ratio of 70 (SERATH YFA05070 manufactured by YKK Corporation) were dispersed in fluorinated silicone oil of a modification degree of 40% (the degree of viscosity: 100 centistokes) in a ratio of 15 wt. %. The resultant suspension was placed in a double wall cylindrical viscometer to measure the ER effect by using the inside cylindrical wall as a positive electrode and the outside cylindrical wall as a negative electrode in the same manner as mentioned above. The results are shown in FIG. 2.

Figure 2:
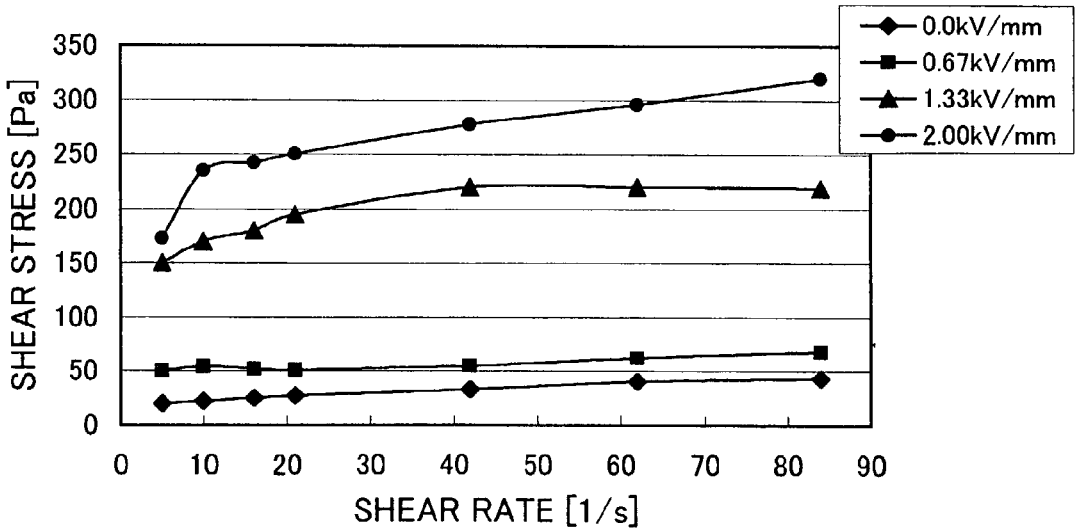
FIG. 2 is a graph showing the change of shear stress with the shear rate measured under the application of various electric fields to the ER composition prepared in Example 2 to be described hereinafter.

As shown in FIG. 2, the suspension exhibited the small shear stress under the application of no voltage, but exhibited the shear stress exceeding 300 Pa under the application of the electric field of 2 kV/mm. The electric current at that time was low, likewise Example 1.

EXAMPLE 3

Tin oxide was adhered to the surfaces of plate-like alumina particles having an average particle diameter of 10 $\mu m$ and an aspect ratio of 30 (SERATH YFA10030 manufactured by YKK Corporation) in a ratio of 5% based on the weight of the plate-like alumina. The resultant plate-like alumina particles having tin oxide adhered thereto were dispersed in fluorinated silicone oil of a modification degree of 40% (the degree of viscosity: 100 centistokes) in a ratio of 30 wt. %. The resultant suspension was placed in a double wall cylindrical viscometer to measure the ER effect by using the inside cylindrical wall as a positive electrode and the outside cylindrical wall as a negative electrode. The results are shown in FIG. 3.

Figure 3:
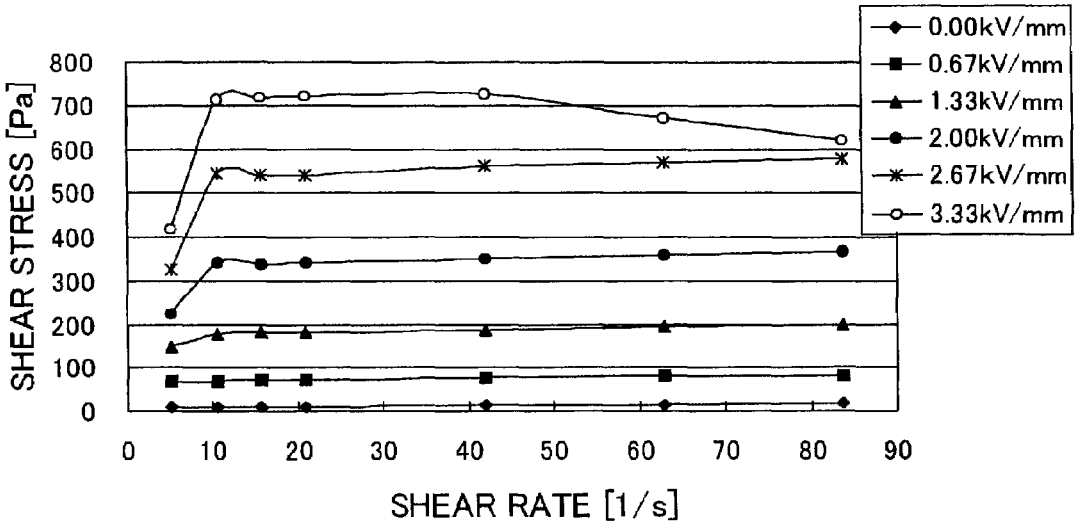
FIG. 3 is a graph showing the change of shear stress with the shear rate measured under the application of various electric fields to the ER composition prepared in Example 3 to be described hereinafter.

As shown in FIG. 3, the suspension exhibited the small shear stress under the application of no voltage, but exhibited the shear stress exceeding 300 Pa under the application of the electric field of 2.0 kV/mm. The electric current at that time was 0.53 $\mu A/cm^2$, as shown in FIG. 6.

EXAMPLE 4

Tin oxide was adhered to the surfaces of plate-like alumina particles having an average particle diameter of 10 $\mu m$ and an aspect ratio of 30 (SERATH YFA10030 manufactured by YKK Corporation) in a ratio of 5% based on the weight of the plate-like alumina. 30 Parts of the resultant plate-like alumina particles having tin oxide adhered thereto were dispersed in 100 parts of dimethyl silicone oil (L-45 manufactured by Nippon Unicar Co., Ltd.). Then, 0.7 part of crude rubber of methyl vinyl siloxane and 10 parts of dimethyl hydrogen polysiloxane were added thereto, and further 1 part of a catalyst solution obtained by dissolving 0.3% of chloroplatinic acid in dimethyl silicone oil was added to the obtained mixture. The resultant mixture was heated to 90° C. for 6 hours to cause gelation. When the dynamic viscoelasticity of the resultant gel was measured, the results shown in FIG. 4 were obtained.

Figure 4:
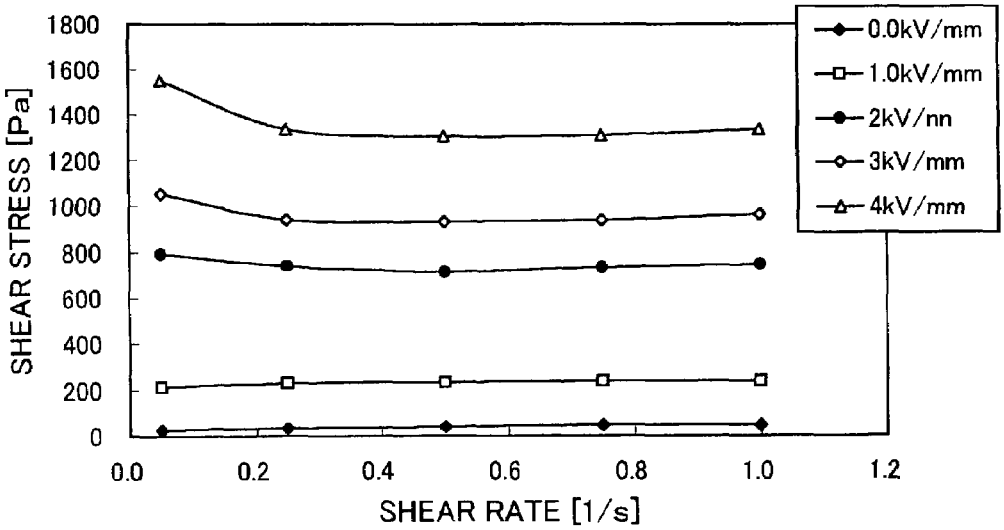
FIG. 4 is a graph showing the change of shear stress with the shear rate measured under the application of various electric fields to the ER composition prepared in Example 4 to be described hereinafter.
Figure 7:
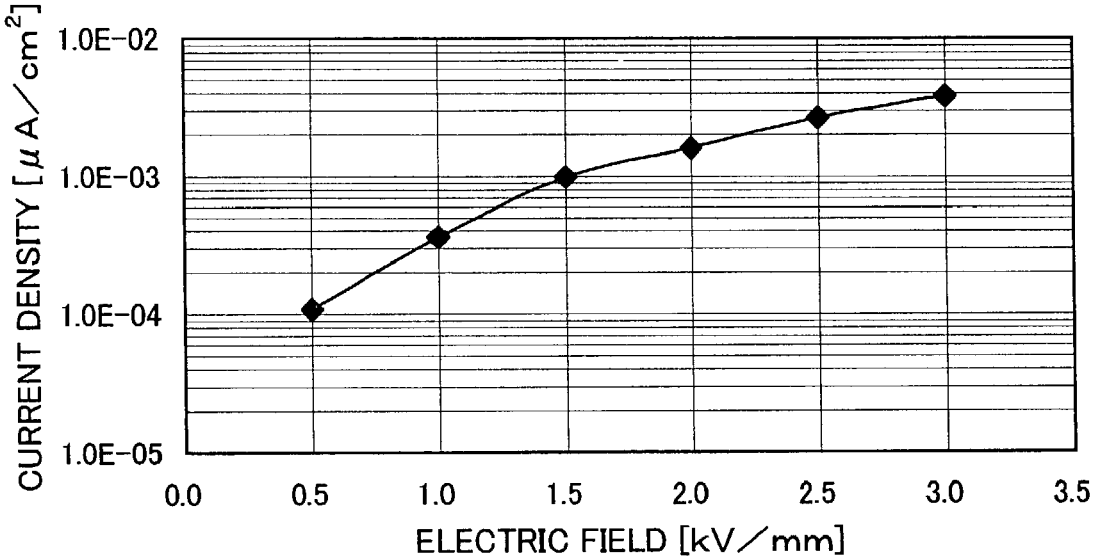
FIG. 7 is a graph showing the change in the current density measured under the application of various electric fields to the ER composition prepared in Example 4.

As shown in FIG. 4, the gel exhibited the dynamic shear stress of 720 Pa at 1% strain, frequency 0.5 Hz, under the application of the electric field of 2 kV/mm. The electric current at that time was 0.0017 $\mu A/cm^2$, as shown in FIG. 7.

EXAMPLE 5

Titanium oxide was adhered to the surfaces of plate-like alumina particles having an average particle diameter of 10 $\mu m$ and an aspect ratio of 30 (SERATH YFA10030 manufactured by YKK Corporation) in a ratio of 2% based on the weight of the plate-like alumina. The resultant plate-like alumina particles having titanium oxide adhered thereto were dispersed in fluorinated silicone oil of a modification degree of 40% (the degree of viscosity: 100 centistokes) in a ratio of 30 wt. %. The resultant suspension was placed in a double wall cylindrical viscometer to measure the ER effect by using the inside cylindrical wall as a positive electrode and the outside cylindrical wall as a negative electrode. The results are shown in FIG. 5.

Figure 5:
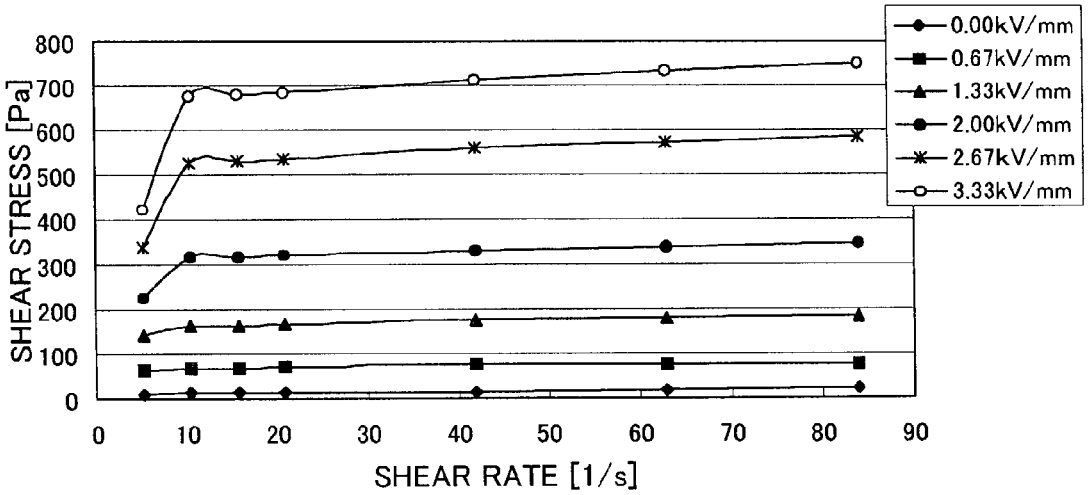
FIG. 5 is a graph showing the change of shear stress with the shear rate measured under the application of various electric fields to the ER composition prepared in Example 5 to be described hereinafter.

As shown in FIG. 5, the suspension exhibited the small shear stress under the application of no voltage, but exhibited the shear stress exceeding 300 Pa under the application of the electric field of 2.0 kV/mm. The electric current at that time was about 10 $\mu A/cm^2$, as shown in FIG. 6.

The changes in the current density measured in Examples 1, 3 and 5 mentioned above are shown in FIG. 6. Further, the change in the current density measured in Example 4 mentioned above is shown in FIG. 7.

As being clear from the results shown in FIG. 6, the electrical conductivity of the composition can be controlled by adhering a metal oxide to the surfaces of the insulating solid particles. Further, as being clear from the results shown in FIG. 7, the electrical conductivity of the composition can be decreased remarkably by gelling the medium.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. An electro-rheological composition comprising an electrical insulating medium and solid particles dispersed therein, characterized in that said solid particles are plate-like insulating solid particles possessed of morphological anisotropy and made of aluminum oxide.

2. The composition according to claim 1, wherein said plate-like insulating solid particles are plate-like aluminum oxide particles having an aspect ratio not less than 5.

3. The composition according to claim 1, wherein said plate-like insulating solid particles are plate-like aluminum oxide particles having a diameter not less than 1 $\mu m$.

4. The composition according to claim 1, wherein said plate-like insulating solid particles are plate-like aluminum oxide produced by hydrothermal synthesis.

5. The composition according to claim 1, wherein said plate-like insulating solid particles are boehmite.

6. The composition according to claim 1, wherein said plate-like insulating solid particles are $\alpha$-alumina.

7. The composition according to claim 1, wherein said insulating solid particles have undergone a surface treatment with organic molecules.

8. The composition according to claim 1, wherein said insulating solid particles have undergone a surface treatment with a coupling agent.

9. The composition according to claim 1, wherein said insulating solid particles have undergone a surface treatment with a semiconducting inorganic material.

10. The composition according to claim 1, wherein said insulating solid particles possessed of morphological anisotropy have a metal oxide adhered to surfaces of said particles.

11. The composition according to claim 10, wherein said metal oxide adhered to surfaces of said insulating solid particles is tin oxide.

12. The composition according to claim 10, wherein said metal oxide adhered to surfaces of said insulating solid particles is titanium oxide.

13. The composition according to claim 10, wherein an amount of said metal oxide adhered to surfaces of said insulating solid particles is not less than 0.01% and not more than 10%, based on the weight of said insulating solid particles.

14. The composition according to claim 1, wherein said electrical insulating medium is silicone oil or fluorinated silicone oil.

15. The composition according to claim 1, wherein said electrical insulating medium is gelled.

16. The composition of claim 1, wherein the composition exhibits an electric current not more than 1 $\mu A/cm^2$ under the application of an electric field of 2 kV/mm and the change in viscosity at the same voltage of not less than 10 times the viscosity under no application of the electric field.

17. The composition of claim 1, wherein the composition exhibits an electric current not more than 0.5 $\mu A/cm^2$ under the application of an electric field of 2 kV/mm and the change in viscosity at the same voltage of not less than 10 times the viscosity under no application of the electric field.

* * * * *